US007474758B2

(12) United States Patent
Beck et al.

(10) Patent No.: US 7,474,758 B2
(45) Date of Patent: Jan. 6, 2009

(54) DIRECTIONAL HEARING GIVEN BINAURAL HEARING AID COVERAGE

(75) Inventors: Frank Beck, Spardorf (DE); Gerhard Sporer, Lauf (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1061 days.

(21) Appl. No.: 10/607,281

(22) Filed: Jun. 26, 2003

(65) Prior Publication Data

US 2004/0057591 A1 Mar. 25, 2004

(30) Foreign Application Priority Data

Jun. 26, 2002 (DE) ..... 102 28 632

(51) Int. Cl.
*H04R 25/00* (2006.01)

(52) U.S. Cl. ..... 381/313; 381/312; 381/315

(58) Field of Classification Search ..... 381/313, 381/315, 1, 23.1, 312, 358, 60
See application file for complete search history.

(56) References Cited

U.S. PATENT DOCUMENTS 5,434,924 A * 7/1995 Jampolsky ..... 381/23.1
5,479,522 A 12/1995 Lindemann et al.
6,044,163 A * 3/2000 Weinfurtner ..... 381/312
6,148,087 A 11/2000 Martin
6,339,647 B1 * 1/2002 Andersen et al. ..... 381/312
6,549,633 B1 * 4/2003 Westermann ..... 381/312
6,681,635 B1 * 1/2004 Van Schaik ..... 73/597

FOREIGN PATENT DOCUMENTS

| | | |
|---|---|---|
| DE | 197 04 119 | 10/1998 |
| DE | 100 48 354 | 5/2002 |
| EP | 0 941 014 | 9/1999 |
| WO | WO 97/14268 | 4/1997 |
| WO | WO 99/43185 | 8/1999 |

* cited by examiner

*Primary Examiner*—Vivian Chin
*Assistant Examiner*—Con P Tran
(74) *Attorney, Agent, or Firm*—Schiff Hardin LLP

(57) ABSTRACT

Directional hearing is improved given the binaural coverage for a hearing aid user with two hearing aid devices wearable at the ears. The respective signal transit times and/or signal amplitudes and/or amplifications of an electrical signal are respectively measured in a signal path between an input transducer and an output transducer and that data with respect to the measured signal transit times and/or signal amplitudes and/or gains is transmitted onto the respectively other hearing aid device. As a result, the signal transit times and the signal amplitudes of the electrical signals through the two hearing aid devices can be matched to one another. The hearing aid devices thus cause no phase or amplitude distortion, and the natural phase shift as well as the natural amplitude difference of a sound signal incident from a specific direction are thus preserved. The directional information is thus also preserved for the hearing aid user.

45 Claims, 3 Drawing Sheets

DIRECTIONAL HEARING GIVEN BINAURAL HEARING AID COVERAGE

BACKGROUND OF THE INVENTION

1. Field of the Invention

The invention is directed to a hearing aid system as well as to a method for the setting of a hearing aid system having at least a first and a second hearing aid device that at least respectively comprise at least one input transducer for the pick-up of an acoustic input signal and conversion thereof into an electrical signal, a signal processing unit for processing the electrical signal and an output transducer for converting the electrical signal into an output signal, and between which a signal path for data transmission is provided.

2. Description of the Related Art

Directional hearing is the ability of a person to distinguish the direction in which a sound source is located. When a sound source is not frontally located in front of or behind the person, a difference in transit time between the two ears and, thus, a time difference with which the ears perceive a sound wave coming from a direction necessarily derives due to the finite propagation speed of sound. When, for example, a sound comes from the right from the point of view of the person, this reaches the right ear a fraction of a second sooner than the left ear. This time difference is far shorter than the person can consciously recognize. The effect arises due to an automatic integration process in the acoustic nerve system.

In addition to the time difference, a difference in the volume with which the ears perceive a sound that comes from one side derives. A sound source at one side of the head conveys a somewhat louder tone to the ear at this side. This minimal difference in the volume also suffices so that the sound source can be localized at the left or right from the point of view of the person.

A loss of directional hearing often occurs given binaural hearing aid coverage. The particular reason for this is that, dependent on the hearing situation that the respective hearing aid device detects, the signal processing of the two hearing aid devices can comprise different steps. Further, the hearing loss for a hearing aid user is usually of a different degree in the two ears. Accordingly, the settings of the hearing aids for compensating the hearing loss of the respective ear are also differently set.

Different settings of the signal processing of the two hearing aids, however, usually result in different signal transit times within the hearing aid devices. An unnatural phase shift of an acoustic input signal that is important for directional hearing therefore occurs. As initially mentioned, the transit time of a sound signal between the two ears is of great significance for directional hearing, in addition to the difference in the volume. Even slight changes of this natural transit time shift as caused, for example, by different signal transit times within the hearing aid devices, can therefore lead to a loss of directional hearing.

For solving this problem, it is known to process the acoustic signals picked up at the two ears in a common, central signal processing device. In addition to two hearing aids worn at a respective ear, U.S. Pat. No. 5,479,522 therefore provides an additional processor unit that, for example, can be implemented as a chest device or wrist watch. The acoustic signals picked up at the two ears pass through the same signal processing steps, so that the phase relationship between the two signals is preserved.

U.S. Pat. No. 5,434,924 discloses that the signal processing given binaural coverage be essentially implemented in only one of the two hearing aid devices. To this end, the signals received at one ear are transmitted onto the hearing aid of the other ear, are processed in common thereat and then supplied to both ears (a master-slave solution).

The first-cited solution has the disadvantage that a further assembly is needed and the hearing aid user now requires three devices instead of two, which means a considerable limitation of the wearing comfort, maintenance and manipulation. The second solution requires that the entire signal processing must be performed by a single signal processing unit at only one side. Whereas adequate space is present in the solution with a third device in order to provide a correspondingly powerful signal processing, the space in a hearing aid situated at the ear is limited. A master-slave solution with two differently fashioned hearing aid devices must therefore necessarily have less of a computational capacity than would be available given utilization of both hearing aid devices.

Another approach to solving this problem is to transmit the incoming sound signals at the hearing aid devices of both sides to the respectively other device and processing both signals at each side. In this way, the acoustic signals picked up at the two ears undergo the same steps of the signal processing in common and therefore automatically experience the same signal delay. This approach proceeds, for example, from International Patent Publications WO 97/14268 and WO 99/43185. Although the transmission of the microphone signals of both sides of a binaural hearing aid system to the respectively other side and the simultaneous processing of both signals at both sides solves the problem of a transit time difference, it is subject to the same limitations as the master-slave approach.

Another significant disadvantage of all of these solutions is that they all require the transmission of large quantities of data. This causes a substantial use of time, space and energy, and represents a considerable disadvantage, particularly given wireless data transfer as offered in the present state of the art.

European Patent Document EP 0 941 014 A2 discloses a hearing aid system with a first and a second hearing aid, whereby control signals are generated by actuating an operating element at the first hearing aid and are transmitted onto the second hearing aid. The simultaneous setting of both hearing aids is thereby effected by the actuation of the operating element at one of the hearing aids.

German Patent Document DE 100 48 354 A1 discloses a method for the operation of a hearing aid system wherein characteristic values of the acoustic field are transmitted from one hearing aid to the other. This can thereby be a matter of signal levels.

German Patent Document DE 197 04 119 C1 discloses a hearing aid wherein a signal transmission from one hearing aid to the other is undertaken via light guides. Control signals can thereby be transmitted.

SUMMARY OF THE INVENTION

An object of the present invention is to support natural directional hearing given a hearing aid system with binaural coverage and to minimize the additional computing outlay required.

This object is achieved by a method for setting a hearing aid system, comprising: providing a first and a second hearing aid device; providing at least one input transducer for each of the first and second hearing aid device; receiving an acoustic input signal by the input transducer and converting the acoustic input signal into an electric signal by the input transducer; processing the electrical signal by a signal processing unit and converting the processed electrical signal into an output signal by an output transducer; providing a signal path for data transmission between the first and second hearing aid device; determining a signal transit time of the electrical signal in a signal path between the input transducer and the output transducer of the first hearing aid device; transmitting a signal via the signal path for data transmission from the first hearing aid device to the second hearing aid device related to the determined signal transit time; and adapting a signal transit time of the electrical signal in a signal path between the input transducer and the output transducer of the second hearing aid device to the determined signal transit time in the first hearing aid device based on the transmitted signal.

The inventive method may, in place of utilizing the signal transit time as the measured and adjusted parameter, utilize an amplification or change in amplification as the parameter. A parameter of the signal amplitude may also be utilized.

The object of the invention is also achieved by a hearing aid system comprising a first and a second hearing aid device, each of which comprise: an input transducer for the pick-up of an acoustic input signal and conversion thereof into an electrical signal; a signal processing unit for processing the electrical signal; and an output transducer for converting the electrical signal into an output signal; the hearing aid system further comprising a signal path for data transmission between the first and second hearing aid device; the first hearing aid device further comprising: a measuring mechanism configured to measure a signal transit time of an electrical signal in a signal path between the input transducer and the output transducer of the first hearing device; and a transmitter for transmitting the measured signal transit time from the first hearing aid device to the second hearing aid device over the signal path for data transmission; the second hearing aid device further comprising: a receiver for receiving the transmitted measured signal transit time; and an adapting mechanism configured for adapting a signal transit time in a signal path between the input transducer and the output transducer of the second hearing aid device based on the received measured signal transit time.

Similarly, the inventive hearing aid system may, in place of utilizing the signal transit time as the measured and adjusted parameter, utilize an amplification or change in amplification as the parameter. A parameter of the signal amplitude may also be utilized.

The object of the invention is also achieved by a hearing aid system comprising: a first and a second hearing aid device, each of which comprise: an input transducer for the pick-up of an acoustic input signal and conversion thereof into an electrical signal; a signal processing unit for processing the electrical signal; and an output transducer for converting the electrical signal into an output signal; the hearing aid system further comprising a signal path for data transmission between the first and second hearing aid device; the first hearing aid device further comprising: a memory configured for storing data related to a signal transit time of an electrical signal in a signal path between the input transducer and the output transducer of the first hearing aid device; and a transmitter configured for transmitting data related to a signal transit time of an electrical signal in a signal path between the input transducer and the output transducer of the first hearing aid device; the second hearing aid device further comprising: a receiver configured for receiving the transmitted data; and an adapting mechanism configured for adapting a signal transit time in a signal path between the input transducer and the output transducer of the second hearing aid device based on the received transmitted data.

DESCRIPTION OF THE DRAWINGS

Further details of the invention are explained in greater detail below on the basis of exemplary embodiments.

DETAILED DESCRIPTION OF THE PREFERRED EMBODIMENTS

Figure 1:
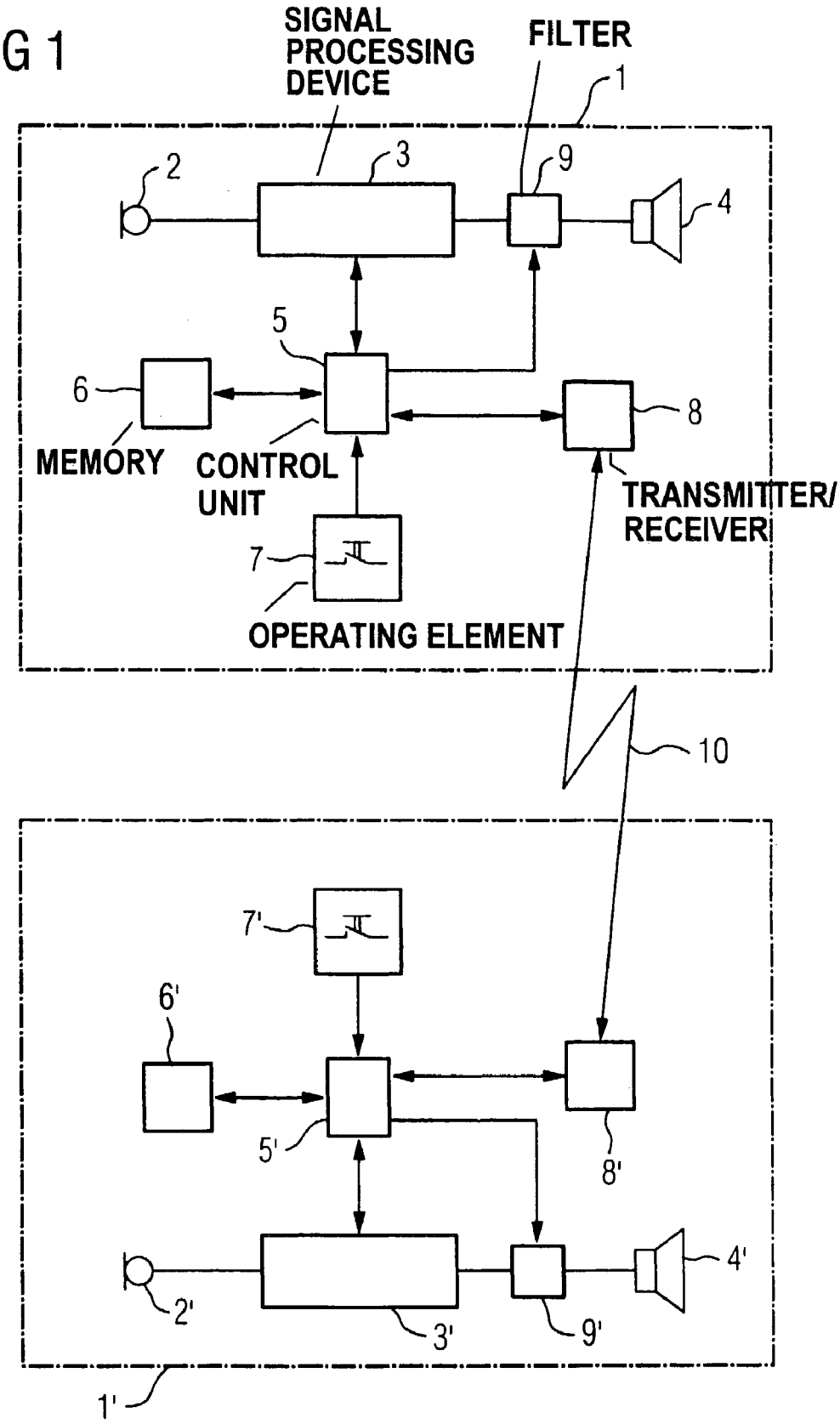
FIG. 1 is a block schematic diagram of a hearing aid system with two hearing aid devices between which a signal path is provided and wherein different hearing programs can be set.

Given a hearing aid system with two hearing aids as known from the initially cited Prior Art, an identical signal transit time in the signal paths of the two hearing aid devices between the microphone and the earphone is respectively generated without explicitly knowing this signal transit time. The high computing outlay and the high data transmission rate that is required as disadvantageous.

In contrast, an embodiment of the invention provides that the signal transit time of the electrical signal in the signal path between the input transducer and the output transducer of the first hearing aid device be determined at least in a relevant sub-region wherein transit time differences may be fundamentally expected, and that the signal transit time of the electrical signal between the input transducer and the output transducer of the second hearing aid device be adapted to the identified signal transit time of the first hearing aid device.

Transit time differences between the two hearing aid devices of a hearing aid system particularly arise due to different settings of the hearing aid devices during operation. These different settings can be conditioned, for example, by a different hearing loss of the two ears of a hearing aid user. In addition to adapting to the user, the settings of a hearing aid device can also serve for adaptation to the respective ambient situation in which the hearing aid device is located at the moment. Since these latter settings ensue adaptively and automatically given modern hearing aide devices, the transit time differences during operation of the hearing aid devices can fluctuate.

In one embodiment of the invention, signal transit times of the first as well as of the second hearing aid device are determined. Suitable transit time measurements are preferably implemented for this purpose. Advantageously, the identified signal transit times also cover the transit times of the input transducers as well as the output transducers, so that their delays can also be taken into consideration. However, only a respective partial region of the signal path between the input transducer and the output transducer can also be measured.

Hearing aid devices usually have a plurality of hearing aid programs available for adapting the signal processing to different hearing situations (for example, “quiet surroundings”, “surroundings with background noise”, “traveling in a car”, “telephone call”, etc.). Advantageously, the hearing aid devices are first individually adapted to the hearing aid user and the signal transit times for the various hearing programs are identified. Based on a comparison of the signal transit times thus identified for both hearing aid devices, a signal delay can be determined for each possible program pairing (two hearing aid devices of a hearing aid system can be operated in different hearing programs at one point in time) by which the signal transit time in the "faster" hearing aid device—i.e. the hearing aid device with the shorter throughput time of an acoustic input signal from the input transducer to the output transducer—must be lengthened so that the same signal transit time is established in both hearing aid devices.

When the information about signal transit times for the individual hearing programs of both hearing aid devices of a hearing aid system as well as the momentary program pairing are known in one hearing aid device and when this hearing aid device has a mechanism available to it for varying the transit time, then the transit time difference can be thereby compensated. Only data for characterizing the current hearing program of the one hearing aid device need therefore be transmitted onto the other hearing aid device. Alternatively, however, data that directly characterize transit times or transit time differences can also be transmitted.

Another embodiment of the invention provides that a signal transit time of an electrical signal is automatically determined at one hearing aid device. Complex measurements at the hearing aid device can thus be eliminated. Further, this embodiment is advantageous given a hearing aid device that adaptively adapts to different hearing situations without thereby comprising a permanently prescribed classification into hearing programs.

The transit time of an electrical signal between the input transducer and the output transducer is then variable within a certain range and can assume nearly arbitrary values within this range of fluctuation. Advantageously, the signal transit time may be internally determined given such a hearing aid device. To this end, for example, the signal transit time through internal components such as signal processors or filters, under the current settings can be known, so that the signal transit times of the individual components merely have to be added up for identifying the overall signal transit time. On the other hand, the signal transit time can also be determined using a test signal that is advantageously supplied following the input transducer and taken preceding the output transducer.

In another embodiment of the invention, a correlation analysis may be implemented for determining the signal transit time of an acoustic input signal through the hearing aid device or the signal transit time of an electrical signal through a sub-region of the hearing aid device. For example, the correlation analysis between the electrical output signal of the microphone and the electrical input signal of the earphone can be implemented. The phase shift between the two signals proceeds from the result of the correlation analysis. Conclusions about the signal transit time can in turn be drawn from the phase shift.

It is provided in a further version of the invention that the envelope is respectively formed at two successive points in the signal path of the hearing aid device and that the phase shift or the signal transit time of the electrical signal between the two points is determined from a comparison of the envelopes.

Data regarding the signal transit time determined in a first hearing aid device are finally transmitted from the first hearing aid device onto the second hearing aid device. The determination of the current signal transit time at the second hearing aid device and the transmission of data with respect thereto from the second hearing aid device onto the first hearing aid device likewise ensue.

Different methods can be applied for the adaptation of different signal transit times of two hearing aid devices of a hearing aid system: First, it is possible to vary the clock frequency of a component of the hearing aid device given a digital hearing aid device. Thus, the hearing aid device having the higher signal transit time can be clocked higher or the hearing aid device with the lower signal transit time can be operated with a reduced clock frequency. On the other hand, it is possible to raise the signal transit time of the hearing aid device with the lower signal transit time using additional components. Given a digital hearing aid device, for example, a shift register can be provided that delays the electrical signal in the signal path of the hearing aid device by a specific number of clocks. Further, a filter can also be utilized that effect a specific phase shift and, thus, delay. All-passes with which the phase shift can be set and that exhibit no influence on the frequency response are preferably utilized as a filter.

The adaptation of the signal transit times of two hearing aid devices of a hearing aid system ensues at periodic time intervals according to a further version of the invention. It is thus assured that the signal transit times of the two hearing aid devices differ at most for a short time duration. The time intervals at which an adaptation ensues can lie in the range of minutes or hours.

Another version of the invention provides that the determination and adaptation of the signal transit times of two hearing aid devices of a hearing aid system ensues following a parameter and/or function modification at at least one of the hearing aid devices. This modification can ensue, for example, by manual operation of at least one of the hearing aid devices by the user. For example, the user can effect a switching of the hearing aid devices into a different hearing program. Since the signal processing in the hearing aid devices thus fundamentally changes, modification in view of the signal transit times in the individual hearing aid devices are also to be expected. A renewed adaptation of the signal transit times is thus implemented for the compensation of the modified signal transit times.

Precisely as in the case of the parameter and/or function change triggered by a manual actuation of an operating element, a compensation of the signal transit times between the hearing aid devices also ensues given an automatic parameter and/or function change of at least one of the hearing aid devices. Given hearing aid devices wherein an automatic situation analysis and adaptation to the momentary hearing situation ensues, the signal transit time at the respectively other hearing aid device can also be adapted. This is particularly important because different functions and settings are selected in such hearing aid systems due to the signal analysis that frequently sequences independently of one another in the two hearing aid devices. For example, a algorithm for feedback suppression can be active or a filter for feedback suppression can be thus set in one hearing aid device wherein feedback-conditioned oscillations are detected without the other hearing aid device being affected by this. Transit time differences for the electrical signals in the individual hearing aid devices can thus result therefrom.

An adaptation of the signal transit times of the two hearing aid devices is preferably always implemented whenever a parameter and/or function change derives at at least one of the hearing aid devices. This is particularly advantageous when a steady or continuous adaptation to the respective ambient situation automatically ensues at both hearing aid devices without a permanently prescribed classification into specific hearing situations and an allocation to predefined hearing programs being thereby present.

Given a hearing aid device of the Prior Art, the signal processing often occurs in parallel in a plurality of parallel channels of a signal processing unit. Each channel thereby normally covers a specific frequency band of the signal to be processed. Since a different signal processing usually ensues for the individual frequency bands, the signal transit times between the individual bands can vary. In order to also compensate this effect, one version of the invention provides that the signal transit times or the amplitude transmission behavior be identified for the individual frequency bands and be matched between the hearing aid devices.

In a hearing aid system according to an embodiment, the directional hearing given binaural hearing aid coverage is improved in that the signal transit times of the hearing aid devices attached to both ears are matched. The signal transit times, however, are only one factor that affects the directional hearing.

In an advantageous development of the hearing aid system of the invention, an adaptation of the amplitude response of the two hearing aid devices also ensues. Differences in the amplitudes of signals that are incident from different directions are especially produced by the occlusion effect of the head. The differences in the amplitudes are thereby very slight and cannot be consciously perceived. These minimal amplitude differences that are caused by different directions of incidence can only be preserved by means of a very fine adaptation of the hearing aid devices of a hearing aid system. The exact height of these differences is thereby of secondary importance. What is significant is that an amplitude difference given a signal from a specific direction is largely preserved, even when settings at one or both hearing aid devices change. When, for example, the volume is increased at one hearing aid device, then an adaptation of the volume should also ensue at the other hearing aid device. Since, however, both ears of a hearing aid user are usually not affected identically by a hearing loss, the volume adaptation can usually not ensue equally at both hearing aid devices. On the contrary, the adaptation must ensue taking the individual hearing curves into consideration that were measured at the two ears of a hearing aid user. What is thus important is that a somewhat higher volume is always conveyed to a hearing aid user at that ear with the shorter distance from the signal source given a signal that comes from a specific direction.

In one embodiment of the invention, an amplification or change in amplification of an electrical signal in at least one of the hearing aid devices is identified given a hearing aid system having two hearing aid devices wearable at the head. The change in amplification can have been caused, for example, by the modification of a parameter of the signal processing of the hearing aid device. Data for characterizing the current amplification or for characterizing the change in amplification are then transmitted onto the other hearing aid device of the hearing aid system. The amplification can then also be correspondingly adapted in this hearing aid device. This can mean that the amplification may be changed by the same amount. Preferably, however, the amplification at the second hearing aid device is modified such that the same loudness impression again arises at both ears as a result of the coverage with the hearing aid devices given a sound signal arriving from the 0° direction (directly from the front). Sound signals deviating from the 0° direction are then perceived again with different loudness impression, so that the hearing aid user can perceive the direction from which the sound signal arrives.

The value of a change in amplification at a hearing aid device according to an embodiment can be permanently allocated to specific settings of functions of the hearing aid device. Given, for example, an algorithm for feedback suppression, a reduction of the gain by 10 dB can thus always be provided. As soon as the algorithm is activated, data for characterizing this change in amplification can then be transmitted onto the other hearing aid device of the hearing aid system, so that a corresponding gain reduction can also implemented thereat.

In many applications, however, there is no fixed allocation between specific functions of the hearing aid device and changes in amplification connected therewith. The amplification or change in amplification can then first be automatically determined in the hearing aid device. To this end, signal amplitudes or signal levels of an electrical signal at points following one another in the signal path of the hearing aid device can be acquired and interpreted.

A test signal is also preferably supplied into the signal path for this purpose, this test signal at least partially traversing the signal processing unit of the hearing aid device. In the amplification adaptation, the amplification is also preferably identified in both hearing aid devices and data with respect thereto are transmitted onto the respectively other hearing aid device. A filter is preferably set for adapting the amplification in one hearing aid device to a change in amplification at a second hearing aid device of a hearing aid system. An adaptation of the amplification of the two hearing aid devices of a hearing aid system is preferably also implemented in the gain adjustment whenever a parameter and/or function change derives at at least one of the hearing aid devices. However, the gain adaptation can also ensue at periodic time intervals. Just like the determination and adaptation of the signal transit time, the determination and adaptation of the gain or amplitude transmission behavior in a hearing aid system with multi-channel hearing aid devices can also be respectively referred to only specific frequency bands.

In an advantageous embodiment of the invention, the transmission behavior of signal amplitudes may also be measured in addition to the determination of signal transit times in the hearing aid devices of a hearing aid system. A test signal can thereby also be supplied into the signal path at one location and be in turn read out therefrom at a following location. When a parameter or function change subsequently ensues at at least one of the hearing aid devices, the transmission behavior with respect to the signal amplitudes can be measured anew and differences in the transmission behavior can be detected. Characteristic data for the signal amplitudes are then transmitted onto the respectively other hearing aid device of the hearing aid system for adaptation to the modified transmission behavior.

The invention can be employed equally given hearing aid system to be worn behind the ear (BtE), to be worn in the ear (ItE) or to be implanted.

Referring to the figures illustrating the preferred embodiments, FIG. 1 shows a schematic illustration of a hearing aid system having two hearing aid devices 1 and 1'. The hearing aid devices 1 and 1' each respectively comprise an acousto-electric input transducer (microphone) 2 or, respectively, 2' for picking up an acoustic input signal and converting it into an electrical signal. The processing of the electrical signal for compensating the hearing loss of a hearing aid user occurs in the signal processing units 3 or, respectively, 3'. Finally, the processed signal may be converted back into a sound signal by a electro-acoustic output transducer (earphone) 4 or, respectively, 4' and supplied to the ears of a hearing aid user.

For adaptation to different hearing situations such as "speech in quiet surroundings", "speech with unwanted noise", "traveling in a car", etc., the hearing aid devices 1 and 1' each may respectively comprise a control unit 5 or, respectively, 5'. The control units 5 and 5' may be connected to memory units 6 or, respectively, 6' in which different parameter sets are stored for adapting the signal processing units 3 or, respectively, 3' to different hearing situations.

The adjustment of the hearing aid devices 1 and 1' to the respective hearing situation may ensue by actuating an operating element 7 or, respectively, 7' at at least one of the hearing aid devices 1 or, respectively, 1'.

According to an embodiment, signal transit times of the signal processing units 3 or, respectively, 3' for the respective hearing programs and taking the respective settings of the hearing aid devices 1 and 1' for compensating the individual hearing loss of a hearing aid user are determined at the hearing aid devices 1 and 1'.

This can ensue, for example, by transit time measurements during the adaptation of the hearing aid devices 1 and 1'. When the signal transit times for both hearing aid devices 1 and 1' under the selected settings for the respective hearing programs are known, then data for characterizing the signal transit times may be allocated to the hearing programs and are likewise deposited in the memory units 6 or, respectively, 6'. These data can be a matter both of the signal transit times per se as well as of the respective transit time differences between the individual hearing programs or the hearing aid devices 1 and 1'.

When, for example, a switch is then made between two hearing programs at the hearing aid device 1, then it is not only the parameters of the new hearing program that are read out from the memory unit 6, but the data for characterizing the signal transit time allocated to the newly set hearing program are also read out. The latter are then transmitted via a transmission and reception unit 8 to the hearing aid device 1'. With the transmission and reception unit 8', the hearing aid device 1' in turn receives the data sent from the hearing aid device 1 and conducts them to the control unit 5'. The latter in turn compares the transmitted data to the information stored in the memory unit 6' with respect to the transit time of the currently set hearing program. For example, any potential transit time differences can then be compensated by controlling a delay that may be implemented as all-pass filter 9 or, respectively, 9' in the exemplary embodiment. Advantageously, both hearing aid devices 1 or, respectively, 1' thus comprise the same signal transit time between the input transducer 2 and the output transducer 4 or, respectively, the input transducer 2' and the output transducer 4'. Directional hearing is thus always enabled with the hearing aid system 1, 1' regardless of the program pairing of the hearing programs of the two hearing aid devices 1 and 1' that may be active at the moment.

Figure 2:
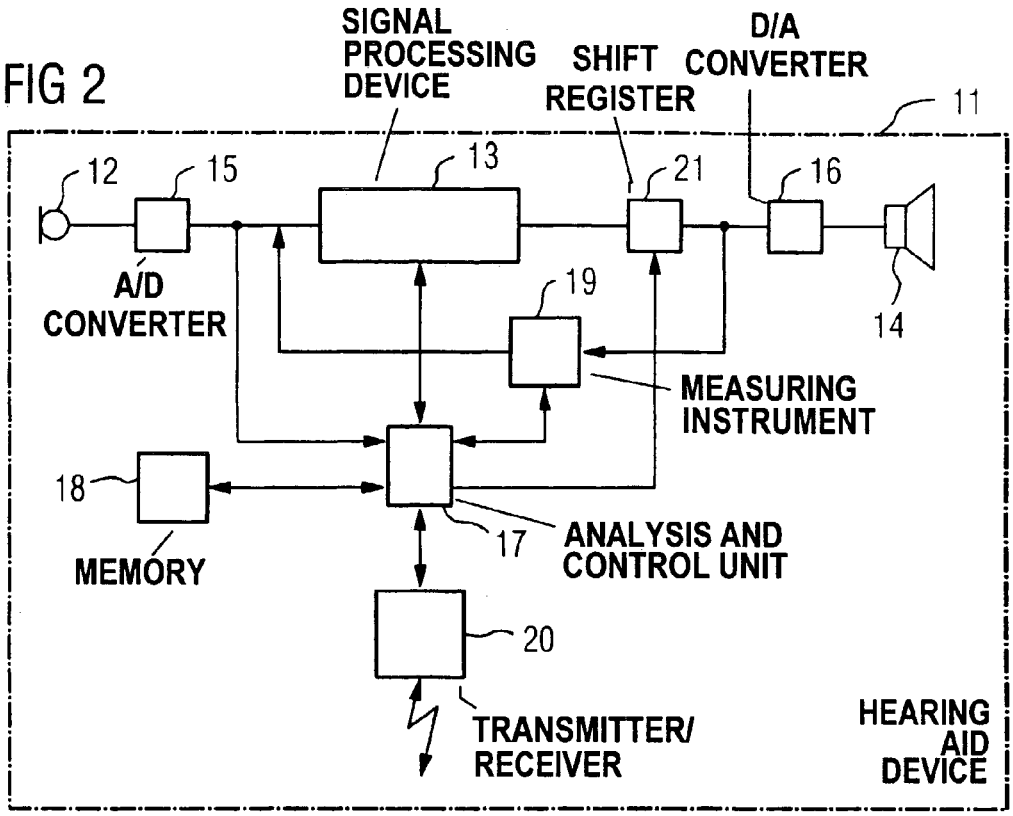
FIG. 2 is a block schematic diagram of a hearing aid device with a signal transit time measuring device and an adjustable delay element.

FIG. 2 shows another embodiment of the invention. Since both hearing aid devices of a hearing aid system thereby comprise the same equivalent circuit diagram, only one of the two is shown in FIG. 2—the hearing aid device 11 in the exemplary embodiment. Like the hearing aid devices 1 and 1' in the exemplary embodiment according to FIG. 1, this also comprises a microphone 12 for picking up an acoustic signal and converting it into an electrical signal, a signal processing unit 13 for the frequency-dependent processing of the electrical signal, and an earphone 14 for converting the electrical signal into an acoustic output signal; The hearing aid device 11 may also comprise an A/D converter 15 for converting the output signal of the microphone into a digital signal as well as a D/A converter 16 for converting the digital signal back into an analog signal before the signal output via the earphone 14.

Differing from the exemplary embodiment according to FIG. 1, a signal analysis of the digital electrical input signal ensues in the hearing aid device 11 according to FIG. 2 in an analysis and control unit 17. This may also be connected to a memory unit 18 in which different stored sets relating to the signal processing can be stored. In addition to the possibility of controlling the signal processing in the hearing aid device 1 with a complete parameter set that is stored in the memory unit 18, it is provided in the hearing aid device 11 that only individual settings and parameters be adaptively modified for setting the signal processing to the respective hearing situation.

As warranted, specific functions or algorithms can also be switched on or, respectively, off. When speech is recognized in the hearing aid device, thus, a algorithm for voice boosting can be set, or an algorithm for noise elimination can be activated when unwanted noises are recognized. A plurality of different settings and functions that usually influence the signal transit time of a signal through the hearing aid device 11 are thus possible, The signal transit time may therefore automatically be determined in the hearing aid device 11 taking the current settings and functions into consideration.

To this end, the hearing aid device 11 may comprise a transit time determination unit 19. This may comprise a signal generator for generating and supplying a synthetic signal into the signal path. The supplied signal passes through the signal processing unit 13 and may be taken before being output via the earphone 14 and is supplied to the transit time determination unit 19. The generated signal preferably lies in a frequency range that cannot be acoustically perceived by the hearing aid user. The signal transit time through the signal processing unit 13 can then be measured by the transit time determination unit 19 and be transmitted to the analysis and control unit 17.

Advantageously, the transit time measurement may be implemented when a parameter or function change has derived at the hearing aid device 11. The identified data relating to the signal transit time may finally be transmitted via a transmission and reception unit 20 onto the second hearing aid device (not shown) of the hearing aid system. Likewise, the hearing aid device 11 may receive the momentary signal transit time through the signal processing unit of the second hearing aid device via the transmission and reception unit 20.

The information with respect to the signal transit times of both hearing aid devices of the hearing aid system are thus present in the analysis and control unit 17. A signal delay that may be the difference of the signal transit times determined in the two hearing aid devices may subsequently be implemented at the hearing aid device having the shorter, identified signal transit time, the hearing aid device 11 in the exemplary embodiment. To this end, the hearing aid device 11 may comprise a delay unit fashioned as shift register 21. The plurality of delay clocks therein can be set by the analysis and control unit 17. What is thus also advantageously achieved given this embodiment is that the same signal transit time is required for the parallel passage of an acoustic input signal through two hearing aid devices of a hearing aid system.

Figure 3:
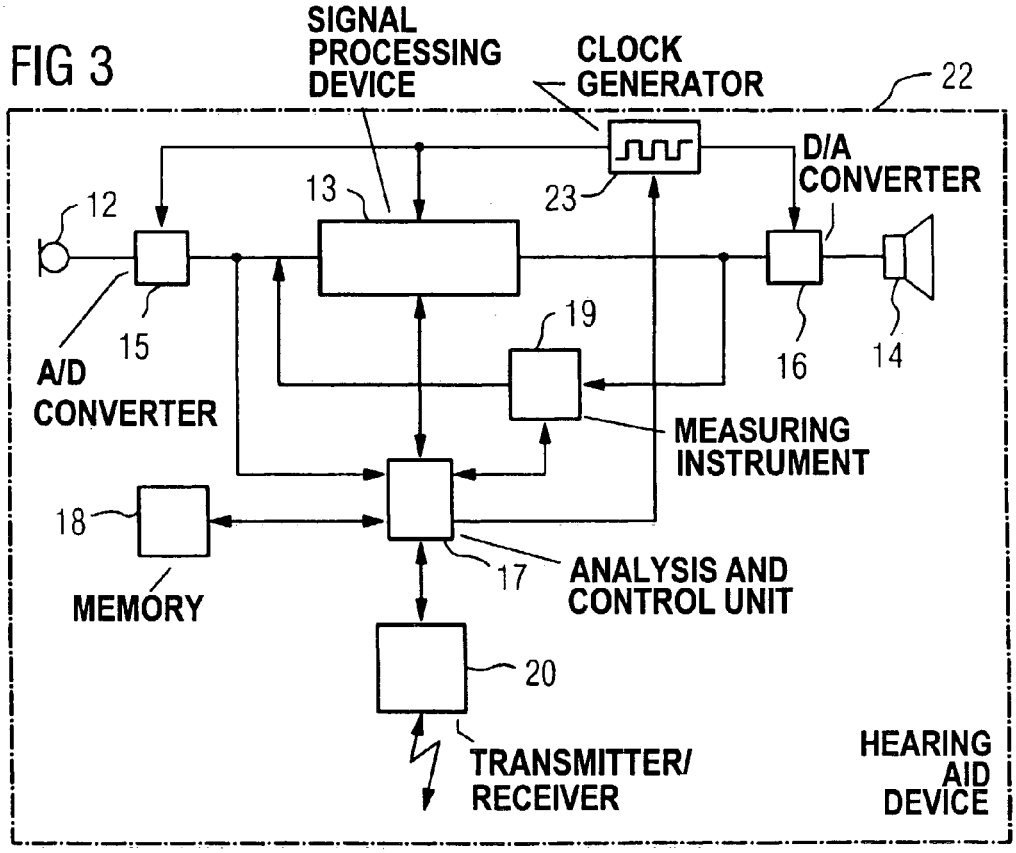
FIG. 3 is a block schematic diagram of a hearing aid device with a signal transit time and amplitude measuring element and adjustable clock frequency.

A further exemplary embodiment of the invention is shown in FIG. 3. A hearing aid device 22 thereby exhibits a structure that is very similar to the exemplary embodiment according to FIG. 2. Differing from the hearing aid device 11 according to FIG. 2, the hearing aid device 22, however, may comprise a clock generator 23 with variable clock frequency. Dependent on the system clock, the signal transit time of a signal through the hearing aid device 22 can thus be varied. When it is found in a way analogous to the hearing aid device described in FIG. 2 that the signal transit time is longer compared to a second hearing aid device of the hearing aid system, then the clock frequency may be increased to such an extent for the compensation of the transit time difference until the transit time difference has been compensated. Correspondingly, the clock frequency of the hearing aid device 22 may be reduced to such an extent given a shorted signal transit time identified for the hearing aid device 22 that the signal transit times are matched.

In a preferred embodiment of the invention, an amplitude compensation may also ensue in addition to the compensation of the signal transit times given changed settings and functions of at least one hearing aid device. Analogous to the compensation of the signal transit times at the hearing aid devices 1 and 1' according to FIG. 1, for example, amplification values can be identified for this purpose and data with respect thereto can be stored in the memory units 6 and 6'. Given a change in amplification at one of the two hearing aid devices as a result of a parameter and/or function change (for example, changing the hearing program), the amplification in the other hearing aid device may then be correspondingly adapted.

An amplitude compensation can also ensue given the hearing aid devices illustrated by way of example in FIGS. 2 and 3. Advantageously, a test signal may be supplied into the signal path via the measuring instrument 19 for this purpose and is in turn taken at a later location in the signal path, preferably following the signal processing unit 13. In addition to the signal transit time, the signal transmission behavior in view of the signal amplitudes is thus also measured. The measurement preferably ensues at different frequencies. Thus, a specific gain value can be respectively determined for different frequencies.

Data with respect to the gain values determined in this way may then be transmitted onto the respectively other hearing aid device of the hearing aid system. A matching of the signal amplitudes may subsequently ensue, whereby the amplification is modified or a filter is set at at least one of the hearing aid devices. Advantageously, the matching of the signal amplitudes may ensue taking the audiograms measured at both ears into consideration. Data with respect to these audiograms can likewise be stored in the memory units 18. The loudness balancing then may ensue in relationship to the audiograms, it being thus achieved, for example, that a slight change in loudness produced by way of a parameter modification at one hearing aid device effects what is a subjectively identical change in loudness for the hearing aid user at the other hearing aid device. As a result thereof, slight differences in loudness at the two ears of a hearing aid user are always identically perceived regardless of the current hearing aid settings.

Figure 4:
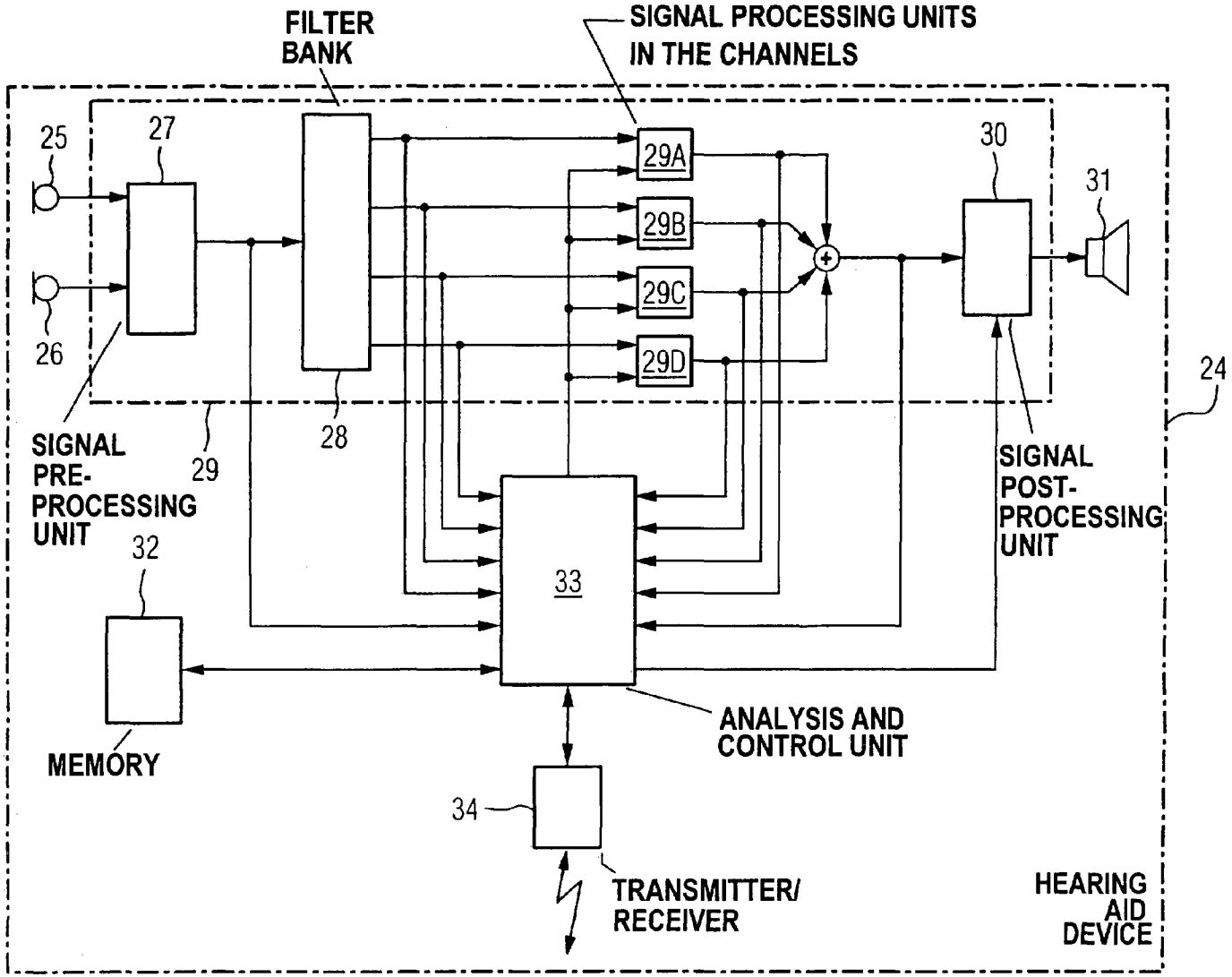
FIG. 4 is a block schematic diagram of a hearing aid device wherein the signal processing ensues in parallel in a plurality of frequency channels, comprising a signal analysis and control unit.

Another exemplary embodiment of the invention is shown in FIG. 4. FIG. 4 also shows only one hearing aid device 24 of a hearing aid system with two identically constructed hearing aid devices. The hearing aid device 24 comprises two microphones 25 and 26 whose output signals are supplied to a signal pre-processing unit 27. An A/D conversion and an electrical interconnection of the microphone signals for generating a directional microphone characteristic may ensue in the signal pre-processing unit 27. A filter bank 28 can serve for splitting the electrical signal into frequency bands.

A frequency band-specific signal processing of the electrical signals in the individual frequency bands can ensue in signal processing units 29A, 29B, 29C and 29D. Finally, the output signals of the signal processing units 29A through 29D are added and post-processed in a signal post-processing unit 30. The signal post-processing can, for example, comprise a final amplification and D/A conversion.

Finally, the analog electrical output signal may be converted back into an acoustic output signal by an earphone 31. The individual signal processing blocks of the hearing aid device, i.e., the signal pre-processing unit 27, the filter bank 28, the signal processing units 29A through 29D in the individual channels as well as the signal post-processing unit 30, are referenced combined as signal processing unit 29 in the exemplary embodiment.

Different hearing programs for adapting the signal processing in the hearing aid device to different hearing situations may also be provided given the hearing aid device 24 in this exemplary embodiment. Corresponding parameter sets may be deposited in a memory unit 32. For recognizing the momentary hearing situation, the hearing aid device 24 can comprise a signal analysis and control unit 33 into which the electrical input signal (before being divided into different frequency bands) as well as the electrical output signal (after passing through the signal processing units 29A through 29D) enter.

For example, feedback-conditioned oscillations in the electrical input signal can be recognized by way of the signal analysis and control unit 33. As a countermeasure to combat feedback-conditioned oscillations that have been recognized, for example, the gain in a frequency band wherein the oscillation frequency lies can then be reduced. Data with respect to this change in amplification in the appertaining channel may then be acquired by the signal analysis and control unit 33 and a transmitted onto the second hearing aid device (not shown) via a transmission and reception unit 34.

This second hearing aid device receives the transmitted data and in turn may reduce the gain in the corresponding channel by way of a signal analysis and control unit corresponding to the signal analysis and control unit of the hearing aid device 24. Data with respect to a change in amplification in the second hearing aid device of the hearing aid system can likewise be transmitted onto the hearing aid device 24, which influences components (for example, the signal processing units 29A through 29D in the individual channels) in a controlling fashion with the signal analysis and control unit 33 and adapts the gain at the hearing aid device 24.

The change in amplification can ensue by the same amount in both hearing aid devices. Preferably, however, it ensues taking the individual hearing loss of the hearing aid user as well as the signal transmission characteristics of the hearing aid devices into consideration. The hearing aid user then subjectively perceives the same reduction in gain at both hearing aid devices. Natural differences in loudness in the acoustic input signals are thereby largely preserved for the hearing aid user.

Parameter or function changes in hearing aid devices as a result of the current hearing situation often do not lead to predefined changes in amplification. This is the case, for example, given hearing aid devices wherein complete parameter sets are not prescribed for the adaptation to different hearing situations but wherein an adaptive and continuous adaptation of individual parameters ensues. A change in amplification may then be advantageously determined using an internal measurement of the hearing aid devices.

Given, thus, the hearing aid device according to FIG. 4, the change in amplification can be determined from measurements before and after a parameter change. To this end, the electrical input signal as well as the electrical output signal are evaluated in the signal analysis and control unit 33. In the exemplary embodiment according to FIG. 4, both an evaluation of the overall input or, respectively, output signal as well as of the electrical input and output signals of the signal processing units 29A through 29D of the individual channels are possible, dependent on whether a parameter modification affects the entire frequency range or only signal frequencies within a frequency band.

Analogous to the adaptation of the gain, the signal amplitudes or the signal transit times of the two hearing aid devices can also be adapted to one another given a hearing aid system with two hearing aid devices having a schematic block circuit diagram according to the exemplary hearing aid device 24 as shown in FIG. 4, so that the natural directional hearing is also preserved when hearing aids are worn. Compared to the amplification matching, other signal analysis methods thereby merely have to be provided in the signal analysis and control unit 33 for the amplitude or transit time compensation. For example, amplitude or level measurements thus precede the amplitude compensation or phase or signal transit time measurements at the overall signal or in the individual channels of the hearing aid device 24 proceed the transit time compensation. The compensation then preferably ensues with an adjustable filter within the signal processing unit 29 that are set by the signal analysis and control unit 33.

A correlation analysis is implemented for transit time measurement in a preferred version. To this end, electrical signals from successive points in the signal path between the microphones 25 and 26 and the earphone 31 may be supplied to the signal analysis and control unit 33. The phase shift and, thus the signal transit time can then be determined in a simple way by using the correlation analysis.

In another preferred embodiment, the envelopes of the supplied signals are first determined in the signal analysis and control unit. Conclusions about the phase shift of the appertaining signals and, thus, about the signal transit time between the points under consideration in the signal path of the hearing aid device 24 can also be easily drawn from the comparison of the envelopes in the signal analysis and evaluation unit 33.

The measurements particularly respectively ensue shortly before as well as shortly after parameter or function changes in the hearing aid device 24 in order to acquire the changes in amplification and/or amplitude and/or signal transit time at the hearing aid device 24 caused as a result thereof, to transmit data with respect thereto onto the second hearing aid device of the hearing aid system, to receive and evaluate them thereat and, finally, to compensate the changes.

In summary, directional hearing may be improved given the binaural coverage for a hearing aid user with two hearing aid devices wearable at the ears. To this end, the embodiments provides that the signal transit times and/or signal amplitudes and/or amplifications of an electrical signal be respectively measured in a signal path between an input transducer and an output transducer and that data with respect to the measured signal transit times and/or signal amplitudes and/or gains be transmitted onto the respectively other hearing aid device.

As a result thereof, the signal transit times and the signal amplitudes of the electrical signals through the two hearing aid devices can be matched to one another. The hearing aid devices thus cause no phase or amplitude distortion, and the natural phase shift as well as the natural amplitude difference of a sound signal incident from a specific direction are thus preserved. The directional information is thus also preserved for the hearing aid user.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly; where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

LIST OF REFERENCE CHARACTERS

| | |
|---|---|
| 1, 1', 11, 22 | hearing aid device |
| 1, 2', 12 | input transducer |
| 3, 3', 13 | signal processing device |
| 4, 4', 14 | earphone |
| 5, 5', 17 | control unit |
| 6, 6', 18 | memory unit |
| 7, 7' | operating element |
| 8, 8', 20 | transmission and reception unit |
| 9, 9' | filter |
| 10 | signal path |
| 15 | A/D converter |
| 16 | D/A converter |
| 17 | analysis and control unit |
| 18 | memory unit |
| 19 | measuring instrument |
| 20 | transmission and reception unit |
| 21 | shift register |
| 22 | hearing aid device |
| 23 | clock generator |
| 24 | hearing aid device |
| 25, 26 | microphones |
| 27 | signal pre-processing unit |
| 28 | filter bank |
| 29A-29D | signal processing units in the channels |
| 30 | signal post-processing unit |
| 31 | earphone |
| 32 | memory unit |
| 33 | signal analysis and control unit |
| 34 | transmission and reception unit |

What is claimed is:

1. A method for setting a hearing aid system, comprising:

providing a first hearing aid device and a second hearing aid device separate from said first hearing aid device;

in each of said first and second hearing aid device, providing, in sequence, an input transducer, a signal processing unit, and an output transducer;

in each of said first and second hearing aid device, receiving an acoustic input signal by the input transducer and converting the acoustic input signal into an electrical signal by the input transducer, and processing the electrical signal by the signal processing unit to produce a processed signal that compensates a hearing impairment and converting the processed electrical signal into an output signal by the output transducer;

providing a signal path for data transmission between the first and second hearing aid devices;

automatically measuring a signal transit time of the electrical signal in a signal path between the input transducer and the output transducer of the first hearing aid device;

automatically transmitting a signal, via the signal path for data transmission from the first hearing aid device to the second hearing aid device, indicating the measured signal transit time; and from the measured signal transit time indicated in the transmitted signal, automatically, at said second hearing aid device, adapting a signal transit time of the electrical signal in a signal path between the input transducer and the output transducer of the second hearing aid device to match the measured signal transit time of the first hearing aid device.

2. The method according to claim 1, further comprising:

measuring said signal transit time by measuring a time needed for passage of an electrical signal through a sub-region of the signal path between the input transducer and the output transducer of the first hearing aid device.

3. The method according to claim 1, wherein measuring the signal transit time of the electrical signal in the first hearing aid device further comprises:

detecting an envelope of the electrical signal; and calculating a phase shift for the detected envelope of the electrical signal and determining the signal transit time dependent on said phase shift.

4. The method according to claim 1, further comprising:

measuring the signal transit time by correlation analysis.

5. The method according to claim 1, further comprising:

generating a test signal for determining the signal transit time, the test signal at least partially traversing the signal path between the input transducer and the output transducer of the first hearing aid device.

6. The method according to claim 1, further comprising:

measuring determining a signal transit time of an electrical signal in a signal path between the input transducer and the output transducer of the second hearing aid device; and transmitting data relating to the signal transmit time via the signal path for data transmission from the second hearing aid device to the first hearing aid device related to the determined signal transit time of the second hearing aid device.

7. The method according to claim 6, further comprising:

determining which is the shorter of: a) the signal transit time in the first hearing aid device, and b) the signal transit time in the second hearing aid device; and introducing a signal delay in the hearing aid device among said first and second hearing aid devices determined to have the shorter signal transit time.

8. The method according to claim 1, wherein the signal processor of said second hearing aid device comprises at least one digital component, and further comprising:

operating said at least one digital component with a clock signal having a clock frequency; and adapting said signal transit time by the clock frequency of said at least one digital component.

9. The method according to claim 1, wherein said second hearing aid device comprises a filter, and further comprising:

adapting the signal transit time by setting said filter.

10. The method according to claim 1, further comprising:

periodically measuring and adapting the signal transit time.

11. The method according to claim 1, further comprising:

implementing at least one of a parameter change and a function change in at least one of the first and second hearing aid devices; and measuring and adapting the signal transit time after implementing the at least one of the parameter change and the function change.

12. The method according to claim 1, further comprising:

providing a plurality of parallel frequency channels for signal processing, and measuring the signal transit time and adapting the signal transit time in at least one of the frequency channels.

13. A method for setting a hearing aid system, comprising:

providing a first hearing aid device and a second hearing aid device separate from said first hearing aid device;

in each of said first and second hearing aid devices, providing in sequence, an input transducer, a signal processing unit, and an output transducer;

in each of said first and second hearing aid devices, receiving an acoustic input signal by the input transducer and converting the acoustic input signal into an electrical signal by the input transducer, and processing the electrical signal by the signal processing unit to produce a processed signal that compensates a hearing impairment and converting the processed electrical signal into an output signal by an output transducer;

providing a signal path for data transmission between the first and second hearing aid devices;

automatically measuring an amplification value or a change in amplification value of an electrical signal in a signal path between the input transducer and the output transducer of the first hearing aid device;

automatically transmitting a signal, via the signal path for data transmission to the second hearing aid device, indicating the measured amplification value or change in amplification value; and from the measured signal transit time indicated in the transmitted signal, automatically, at said second hearing aid device adapting an amplification of an electrical signal in a signal path between the input transducer and output transducer of the second hearing aid device match the measured amplification value or change in amplification value of the first hearing aid device.

14. The method according to claim 13, further comprising:

measuring said amplification or amplification change of the electrical signal for a sub-region of the signal path between the input transducer and the output transducer of the first hearing aid device.

15. The method according to claim 13, further comprising:

generating a test signal for measuring the amplification or amplification change, the test signal at least partially traversing the signal path between the input transducer and the output transducer of the first hearing aid device.

16. The method according to claim 13, further comprising:

utilizing at least one of signal amplitudes and signal levels of the electrical signal for measuring the amplification or amplification change.

17. The method according to claim 13, further comprising:

measuring an amplification or amplification change of an electrical signal in a signal path between the input transducer and the output transducer of the second hearing aid device; and transmitting a signal via the signal path for data transmission from the second hearing aid device to the first hearing aid device related to the measured amplification or amplification change of the second hearing aid device.

18. The method according to claim 13, wherein said second hearing aid device comprises a filter, and further comprising:

adapting the amplification of the second hearing aid device by setting said filter.

19. The method according to claim 13, further comprising:

periodically measuring and adapting the amplification or amplification change.

20. The method according to claim 13, further comprising:

implementing at least one of a parameter change and a function change in at least one of the first and second hearing aid devices; and measuring the amplification and adapting the amplification after implementing the at least one of the parameter change and the function change.

21. The method according to claim 13, further comprising:

providing a plurality of parallel frequency channels for the signal processing, measuring the amplification and adapting the amplification in at least one of the frequency channels.

22. A method for setting a hearing aid system, comprising:

providing a first hearing aid device and a second hearing aid device separate from said first hearing aid device;

in each of said first and second hearing aid devices, providing, in sequence, an input transducer, a signal processing unit and an output transducer;

in each of said first and second hearing aid devices, receiving an acoustic input signal by the input transducer and converting the acoustic input signal into an electrical signal by the input transducer, and processing the electrical signal by a signal processing unit to produce a processed signal that compensates a hearing impairment and converting the processed electrical signal into an output signal by an output transducer;

providing a signal path for data transmission between the first and second hearing aid devices;

automatically measuring a signal amplitude of an electrical signal in a signal path between the input transducer and the output transducer of the first hearing aid device;

automatically transmitting a signal, via the signal path for data transmission to the second hearing aid device, indicating the measured signal amplitude; and from the measured signal transit time indicated in the transmitted signal, automatically, at said second hearing aid device, adapting an amplification of an electrical signal in a signal path between the input transducer and output transducer of the second hearing aid device to match the measured signal amplitude of the first hearing aid device.

23. The method according to claim 22, further comprising:

generating a test signal for measuring the signal amplitude, the test signal at least partially traversing the signal path between the input transducer and the output transducer of the first hearing aid device.

24. The method according to claim 22, further comprising:

measuring a signal amplitude of an electrical signal in a signal path between the input transducer and the output transducer of the second hearing aid device; and transmitting a signal via the signal path for data transmission from the second hearing aid device to the first hearing aid device related to the determined signal amplitude of the second hearing aid device.

25. The method according to claim 22, wherein said second hearing aid device comprises a filter, and further comprising:

adapting the signal amplitude of the second hearing aid device by setting said filter.

26. The method according to claim 22, further comprising:

periodically measuring and adapting the signal amplitude.

27. The method according to claim 22, further comprising:

implementing at least one of a parameter change and a function change in at least one of the first and second hearing aid devices; and measuring the signal amplitude and adapting the signal amplitude after implementing the at least one of the parameter change and the function change.

28. The method according to claim 22, further comprising:

providing a plurality of parallel frequency channels for the signal processing, and measuring and adapting the signal amplitude in at least one of the frequency channels.

29. A hearing aid system, comprising:

a first hearing aid device and a second hearing aid device, each comprising:

an input transducer for receiving an acoustic input signal and conversion thereof into an electrical signal;

a signal processing unit for processing the electrical signal to produce a processed signal that compensates a hearing impairment; and an output transducer for converting the processed signal into an output signal;

the hearing aid system further comprising a signal path for data transmission between the first and second hearing aid devices;

the first hearing aid device further comprising:

a measuring circuit configured to measure a signal transit time of an electrical signal in a signal path between the input transducer and the output transducer of the first hearing device; and a transmitter for transmitting a signal indicating the measured signal transit time from the first hearing aid device to the second hearing aid device over the signal path for data transmission;

the second hearing aid device further comprising:

a receiver for receiving the transmitted signal; and an adapting circuit configured for adapting a signal transit time in a signal path between the input transducer and the output transducer of the second hearing aid device to match the measured signal transit time indicated in the received signal.

30. The hearing aid system according to claim 29, wherein the measuring circuit comprises a correlator configured to perform a correlation analysis on the electrical signal.

31. The hearing aid system according to claim 29, wherein the second hearing aid devices comprises an adjustable signal delay circuit and wherein said adapting circuit adjusts said signal delay circuit to adapt said signal transit time.

32. The hearing aid system according to claim 29, wherein the signal processing units of the second hearing aid device comprises at least one digital component operating with an adjustable clock frequency, and wherein said adapting circuit adjusts said clock frequency to adapt said signal transmit time.

33. The hearing aid system according to claim 29, further comprising:

a plurality of parallel frequency channels for the first and second hearing aid devices in which the signal processing occurs;

wherein the measuring mechanism of at least the first hearing aid device is configured to measure the signal transit time in at least one frequency channel in the first hearing aid device; and the adapting mechanism of at least the second hearing aid device is configured to adapt the signal transit time in at least one frequency channel in the second hearing aid device.

34. The hearing aid system according to claim 29, wherein:

the first hearing aid device further comprises at least one transmission unit configured to wirelessly transmit said signal to the second hearing aid device; and the second hearing aid device further comprises at least one reception unit configured to wirelessly receive said signal from the first hearing aid device.

35. The hearing aid system according to claim 29, wherein at least the first hearing aid device further comprises a test signal generator configured to generate a test signal for measuring said transit time.

36. A hearing aid system, comprising:

a first hearing aid device and a second hearing aid device, each comprising:

an input transducer for receiving an acoustic input signal and conversion thereof into an electrical signal;

a signal processing unit for processing the electrical signal to produce a processed signal that compensates a hearing impairment; and an output transducer for converting the processed signal into an output signal;

the hearing aid system further comprising a signal path for data transmission between the first and second hearing aid devices;

the first hearing aid device further comprising:

a measuring circuit configured to measure an amplification or amplification change of an electrical signal in a signal path between the input transducer and the output transducer of the first hearing device; and a transmitter for transmitting a signal indicating the measured amplification or amplification change from the first hearing aid device to the second hearing aid device over the signal path for data transmission;

the second hearing aid device further comprising:

a receiver for receiving the transmitted signal; and an adapting circuit configured for adapting an amplification in a signal path between the input transducer and the output transducer of the second hearing aid device to match the measured amplification or amplification change indicated in the received signal.

37. The hearing aid system according to claim 36, further comprising:

a plurality of parallel frequency channels for the first and second hearing aid devices in which the signal processing occurs;

wherein the measuring circuit of at least the first hearing aid device is configured to measure the amplification or amplification change in at least one frequency channel in the first hearing aid device; and the adapting circuit of at least the second hearing aid device is configured to adapt the amplification in at least one frequency channel in the second hearing aid device.

38. The hearing aid system according to claim 36, wherein:

the first hearing aid device further comprises at least one transmission unit configured to wirelessly transmit said signal to the second hearing aid device; and the second hearing aid device further comprises at least one reception unit configured to wirelessly receive said signal from the first hearing aid device.

39. The hearing aid system according to claim 36, wherein at least the first hearing aid device further comprises a test signal generator configured to generate a test signal for measuring said amplification or amplification change.

40. A hearing aid system, comprising:

a first hearing aid device and a second hearing aid device, each comprising:

an input transducer for receiving an acoustic input signal and conversion thereof into an electrical signal;

a signal processing unit for processing the electrical signal to produce a processed signal that compensates a hearing impairment; and an output transducer for converting the processed signal into an output signal;

the hearing aid system further comprising a signal path for data transmission between the first and second hearing aid devices;

the first hearing aid device further comprising:

a measuring circuit configured to measure a signal amplitude of an electrical signal in a signal path between the input transducer and the output transducer of the first hearing device; and a transmitter for transmitting a signal indicating the measured signal amplitude from the first hearing aid device to the second hearing aid device over the signal path for data transmission;

the second hearing aid device further comprising:

a receiver for receiving the transmitted signal; and an adapting circuit configured for adapting a signal amplitude in a signal path between the input transducer and the output transducer of the second hearing aid device to match the measured signal amplitude indicated in the received signal.

41. The hearing aid system according to claim 40, further comprising:

a plurality of parallel frequency channels for the first and second hearing aid devices in which the signal processing occurs;

wherein the measuring circuit of at least the first hearing aid device is configured to measure the signal amplitude in at least one frequency channel in the first hearing aid device; and the adapting mechanism of at least the second hearing aid device is configured to adapt the signal amplitude in at least one frequency channel in the second hearing aid device.

42. The hearing aid system according to claim 40, wherein:

the first hearing aid device further comprises at least one transmission unit configured to wirelessly transmit the signal to the second hearing aid device; and the second hearing aid device further comprises at least one reception unit configured to wirelessly receive the signal from the first hearing aid device.

43. The hearing aid system according to claim 40, wherein at least the first hearing aid device further comprises a test signal generator configured to generate a testing signal for measuring said signal amplitude.

44. A hearing aid system, comprising:

a first hearing aid device and a second hearing aid device, each comprising:

an input transducer for receiving an acoustic input signal and conversion thereof into an electrical signal;

a signal processing unit for processing the electrical signal to produce a processed signal that compensates a hearing impairment; and an output transducer for converting the processed signal into an output signal;

the hearing aid system further comprising a signal path for data transmission between the first and second hearing aid devices;

the first hearing aid device further comprising:

a memory configured for storing data related to a signal transit time of an electrical signal in a signal path between the input transducer and the output transducer of the first hearing aid device; and a transmitter configured for transmitting said data from said memory related to said signal transit time via said signal path for data transmission;

the second hearing aid device further comprising:

a receiver configured for receiving the transmitted data via the signal path for data transmission; and an adapting circuit configured for adapting a signal transit time in a signal path between the input transducer and the output transducer of the second hearing aid device to match the received transmitted data.

45. The hearing aid system according to claim 44, wherein the first hearing aid device further comprises:

a plurality of parameter sets for adapting the signal processing in the first hearing aid device to different hearing situations;

a memory for storing the plurality of parameter sets in the first hearing aid device;

a setting circuit for setting values of the parameter sets; and a circuit for allocating said data with respect to the signal transit time of an electrical signal in the signal path between the input transducer and the output transducer of the first hearing aid device to at least one parameter set.

* * * * *